United States Patent [19]

Philippon

[11] 4,040,561

[45] Aug. 9, 1977

[54] PROCESS AND INSTALLATION FOR PACKING A LIQUID PASTY, OR GRANULAR PRODUCT AND A PACKING CONTAINER

[75] Inventor: Raymond C. Philippon, Saint-Cloud, France

[73] Assignee: Societe Anonyme dite: Etude et Realisation de Chaines Automatiques - ERCA, France

[21] Appl. No.: 571,204

[22] Filed: Apr. 24, 1975

[30] Foreign Application Priority Data

Apr. 25, 1974 France ..... 74.14503

[51] Int. Cl.[2] ..... B65D 5/64; B65D 77/00

[52] U.S. Cl. ..... 229/43; 206/217; 220/257; 220/259

[58] Field of Search ..... 206/217; 229/43, 2.5; 220/23, 257, 259

[56] References Cited

U.S. PATENT DOCUMENTS

| | | | |
|---|---|---|---|
| 1,915,503 | 6/1933 | Schmidt | 229/43 X |
| 3,194,479 | 7/1965 | Rumberger | 229/43 |
| 3,561,668 | 2/1971 | Bergstrom | 229/43 |

*Primary Examiner*—Leon Gilden
*Attorney, Agent, or Firm*—Bucknam and Archer

[57] ABSTRACT

A process for packing a liquid, pasty or granular product, comprises: thermoforming, in a first chain of work stations, juxtaposed containers from a first band of thermoplastic material, these containers remaining joined to the first band by their top edges, which are in the same plane as the first band; filling the containers so formed with the product; thermoforming, a second chain of work stations superimposed on the first plurality of work stations, profiled closure lids from a second band of thermoplastic material; moving the second band stepwise and in synchronism with the first band so that each closure lid covers the open end of a respective filled container; covering the closure lids with a guarantee sheet formed from a guarantee band; sealing each guarantee sheet on the rim of the respective closure lid simultaneously with sealing of said closure lid to a rim of the respective container; and separating the sealed containers from one another, each closure lid being formed of a profiled portion a part of whose periphery is cut from the second band inside a closed cutting line arranged to coincide with the periphery of the rim of the respective container, leaving between the partially cut periphery of the profiled portion and the adjacent part of the second band a linear connection extending in a straight line in the plane of, and perpendicular to the edges of the second band, the profiled portions of the closure lids being disposed on the respective containers while still attached to the first band, after the guarantee band has been placed on the second band the guarantee band being sealed to the closure band and the latter on the flat portion of the second band, outside the partially cut periphery of the profiled portion of each lid, along a zone which is closed on itself and is parallel to the said periphery, containers being separated from each other by a cut extending outwardly of said zone.

The invention also concerns an installation for carrying out this process and a packing container made by the process or installation.

7 Claims, 11 Drawing Figures

10
12e
12d
12c
12a
III 12d
12c
12f
12e
12a 10
12h
12g
12i
IV 12g
12h
12a 80
10
70
12h
VII
12k
12g 70
n
6a
12a
12h
6

FIG. 10
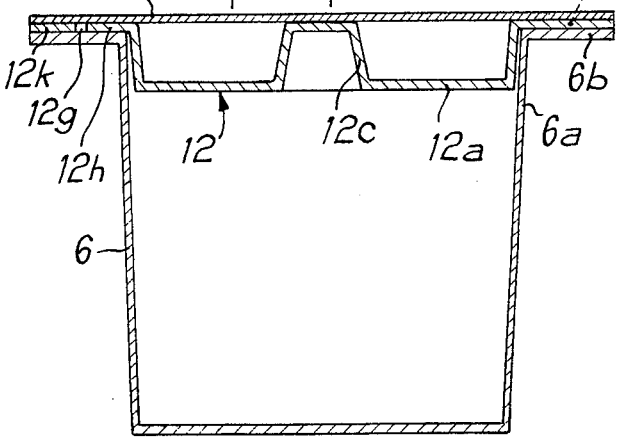
FIG. 8
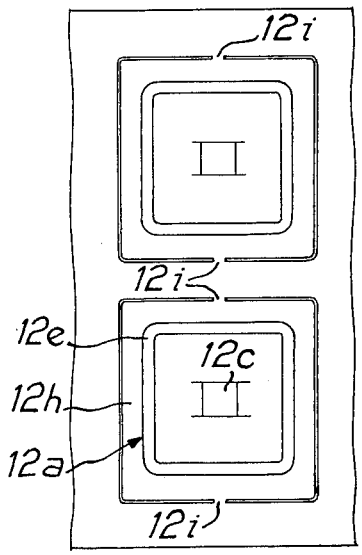
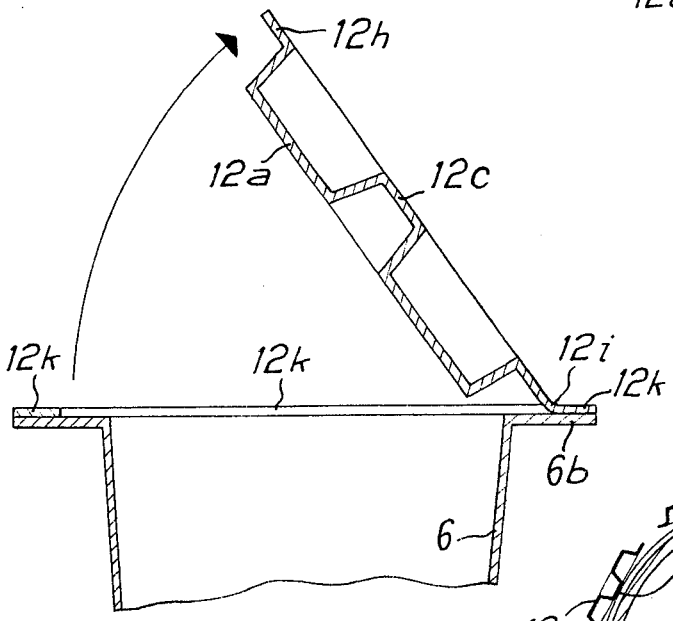
FIG. 11
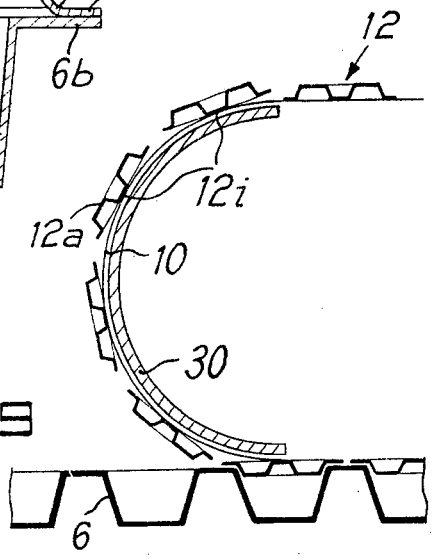
FIG. 9

PROCESS AND INSTALLATION FOR PACKING A LIQUID PASTY, OR GRANULAR PRODUCT AND A PACKING CONTAINER

The present invention relates to processes and installations for packing liquids, pasty, or granular products and to packing containers.

In one known process profiled lids of packing containers are brought from their production level to a level of a band from which containers are formed in a trajectory having a polygonal shape whose sides are formed by the planes in which the rims of the various lids are situated, these different planes being tangent to a semi-cylinder of circular section whose generatrices are parallel to that of the planes of the production level of the lids and that of the container band and extend perpendicularly to the direction of advance of the band from which the lids are made and the band from which the containers are made. The folds in the band from which the lids are made are therefore situated between the rear edge of a first transverse series of lids and the front edge of the second transverse series, that is to say of the following series of lids, and so on.

Because of this design, the lids on the polygonal trajectory are subjected to oblique thrust and traction forces which frequently lead to local displacement of the lids in relation to the open end of the containers which are to be closed, so that the containers are poorly closed and numerous re-adjustments of the lids in relation to the containers are necessary. This disadvantage of the known process cannot be avoided with a guide of polygonal shape, because supporting cross-bars of this guide constitute an additional obstacle in the path of the lids.

In order to avoid these disadvantages it has been proposed, particularly in U.S. Pat. No. 3,561,668 first to cut out individually the lid from a band before transferring them to the level of the band of containers and placing them on the corresponding containers. Nevertheless, the relatively large transfer path substantially slows down the rate of production both of the containers and of the lids. Furthermore, since once they have been cut out, the lids are no longer held by the band from which they have been made problems then arise in the exact positioning of the lids on the containers and the maintaining of the lids in their position during the stepwise advance of the assembly comprising the container and the respective lid before the sealing of the container.

French Patent Specification No. 2,179,801 describes a process for transporting profiled lid portions to the containers, wherein a partial periphery around the profiled lid is cut out from a band leaving a number of connecting tongues between this profiled lid and the lid band. This cutting-out coincides with the periphery of the finished edge of the lid and, when the lids are at the level of the containers, the connecting tongues are broken and the lid is placed on the containers. Since the profiled portions of the lids are not held by the band during their placing in position on the containers and their transfer together with these containers, the exact positioning of the lids and their maintenance in position on the containers cannot be effected accurately. Furthermore, in this process no provision is made for sealing the lids on the containers and for attaching a guarantee band. Finally, the lids are carried over a linear path perpendicular to that of the containers, the chanins producing the containers and the lids are not superimposed, and the installation is therefore cumbersome.

According to one aspect of the present invention there is provided a process for packing a liquid, pasty, or granular product, comprising: thermoforming, in a first plurality of work stations, juxtaposed containers from a first band of thermoplastic material, these containers remaining joined to the first band by their top edges, which are on the same plane as the first band; filling the containers so formed with the product; thermoforming, in a second plurality of work stations superimposed on the first plurality of work stations, profiled closure lids from a second band of thermoplastic material; moving the second band stepwise and in synchronism with the first band so that each closure lid covers the open end of a respective filled container; covering the closure lids with a guarantee sheet formed from a guarantee band; sealing each guarantee sheet on the rim of the respective closude lid simultaneously with sealing of said closure lid to a rim of the respective container; and separating the sealed containers from one another, each closure lid being formed after a profiled portion a part of whose periphery is cut from the second band inside a closed cutting line arranged to coincide with the periphery of the rim of the respective container, leaving between the partially cut periphery of the profiled portion and the adjacent part of the second band a linear connection extending in a straight line in the plane of and perpendicular to the edges of the second band, the profiled portions of the closure lids being disposed on the respective containers whilst still attached to the first band; after the guarantee band has been placed on the second band and the guarantee band being sealed to the closure band and the latter on the flat portion of the second band, outside the partially cut periphery of the profiled portion of each lid, along a zone which is closed on itself and is parallel to the said periphery containers being separated from each other by a cut extending outwardly of said zone.

Preferably, the second plurality of work stations is driven stepwise by steps which are longer than the steps by which the first plurality of work stations are driven.

According to a further aspect of the present invention there is provided an installation for packing a liquid, pasty or granular product comprising: a first plurality of work stations for thermoforming from a first band of thermoplastic material, a plurality of juxtaposed containers, the containers remaining joined to the first band by their top edges, which are in the same place as the first band, and for filling the containers with a product; a second plurality of work stations for thermoforming from a second band of thermoplastic material; profiled closure lids means for moving the second band stepwise and in synchronism with the first band so that each closure lid covers the open end of a respective filled container; a first further station for covering the closure lids with a closure sheet formed from a guarantee band; a second further station for sealing each guarantee sheet on the rim of a respective closure lids simultaneously with sealing of said closure lid to the rim of a respective container; and a third further station separating the sealed containers from one another, the second plurality of work stations including a station for forming each closure lid with a profiled portion, and a partial cutting station including cutters for partially cutting the periphery of the profiled portion of each closure lid from the second band and inside a closed cutting line arranged to coincide with the periphery of the rim of the respective container, leaving between the partially cut periphery of the profiled portion and the adjacent part of the second band a linear connection extending in a straight line extending in the plane of, and perpendicular to the edges of the second band, said second further station the inside distance between welding means thereof is greater than the distance between the cutters of the partial cutting station, the installation also including synchronisation means for synchronising the movements of the first and second bands.

Preferably the synchronisation means includes a speed variator.

According to a further aspect of the present invention there is provided a packing container provided with a profiled closure lid and a guarantee sheet, the closure lid being sealed on a flat rim of the container and the guarantee sheet being sealed on the edge of the closure lid, the closure lid comprising a flat ring which is sealed to the flat rim of the container and whose outer periphery coincides with the outer periphery of the flat rim of the container, a flat dish rim being formed inside the flat ring and resting freely on an inner marginal zone of the flat rim of the container the dish rim having an outer periphery of substantially the same shape as the inner periphery of the said flat ring, and is partially connected to the said flat ring by at least one attachment tongue made of the same material as the flat ring and the dish rim, the guarantee sheet being provided to seal only on the flat ring.

In one embodiment, the at least one attachment tongue is disposed in a straight line coinciding with one of the edges of the dish rim.

In another embodiment the dish rim is connected to the flat ring by two attachment tongues situated along two opposite sides of the said dish rim and in a straight line perpendicular to said two opposite sides. Thus the straight line passing through the two attachment tongues may also pass through a gripping button provided on the profiled closure lid.

Preferably the at least one said attachment tongue is provided with an incision or weakening line.

The invention is illustrated, merely by way of example, in the accompanying drawings, in which:

FIG. 8 is a bottom plan view of a portion another form of lid band for a packing container according to the present invention;

FIG. 9 is a diagrammatic side view of lid band of FIG. 8 during its transport between the upper level and the lower level of the installation of FIG. 1;

FIG. 10 is a view in axial section of a sealed packing container according to the present invention; and, FIG. 11 is a view in axial section of the container shown in FIG. 10, the guarantee sheet being removed and the profiled lid being partially lifted.

Figure 1:
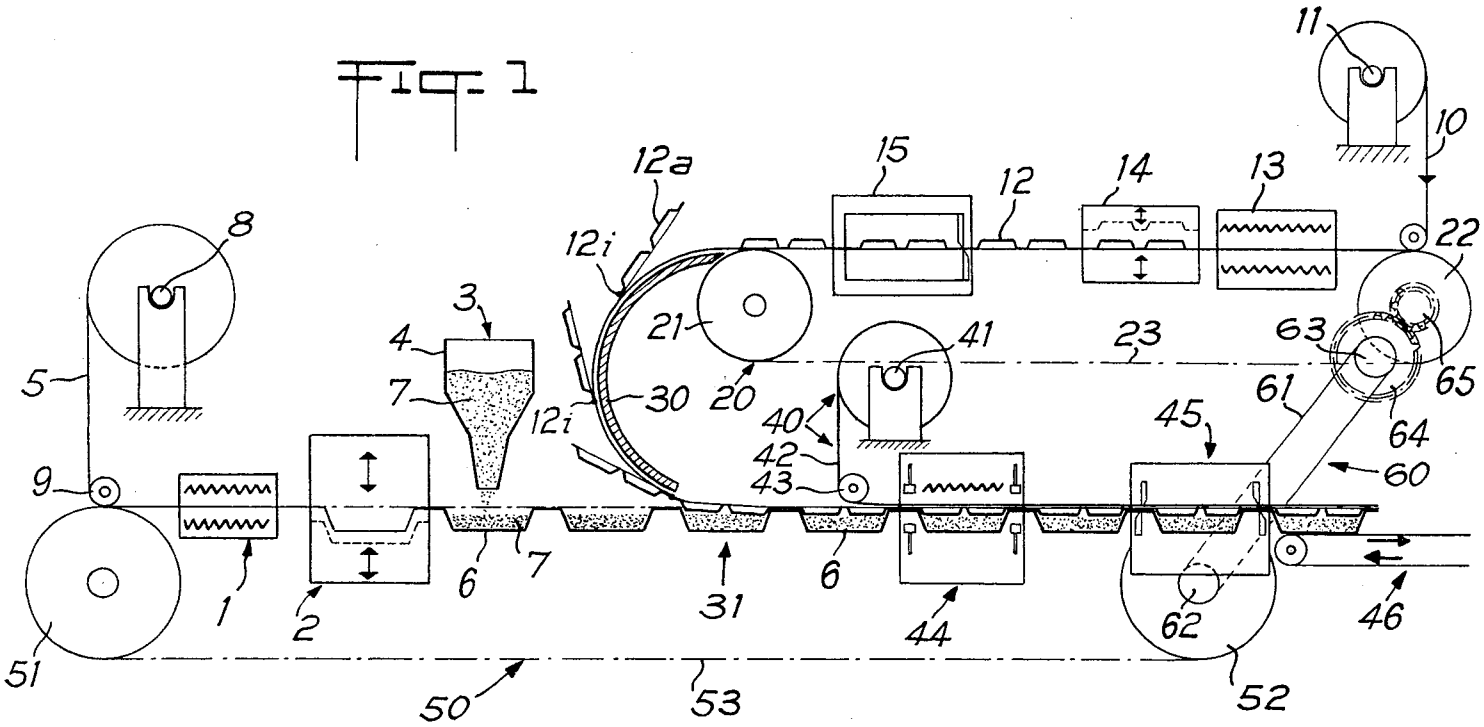
FIG. 1 is a schematic view of an installation according to the present invention.

As can be seen in FIG. 1, an installation according to the present invention for packing liquid, pasty, or granular products comprises, on a first or lower level, a chain of work stations 1, 2, 3 for producing containers 6 from a thermoplastic container band 5, and for filling them with a product 7. The first work station 1 is a heating station intended to bring the band 5, which is stored on a support reel 8 and passes over a guide roller 9, to the thermoforming temperature. The second work station 2 is a thermoforming station in which the containers 6 are formed, in the conventional manner, and in such a way as to have their open ends in the plane of the band. The third work station 3 is a filling station containing, in a reservoir 4, the product 7 which is to be introduced into the containers 6.

On a second level, or upper level, there is a second chain of work stations 13, 14, 15 for producing, likewise by thermoforming, a profiled closure lid 12 from a thermoplastic lid band 10 and stored on a support reel 11. The first work station 13 is a heating station for bringing the band 10 to the thermoforming temperature. The second station 14 is a thermoforming station which forms from the band 10 profiled portions **12*a* of the lids 12. The third station 15 is a partial cutting-out station whose cutters and counter-cutters are so arranged as to be able to cut out from the band 10 part of the periphery of the profiled portions 12*a* of the lids 12, while leaving at least one attachment or connection tongue 12*i* between the profiled portion 12*a* and the band 10, the tongue or tongues being aligned perpendicular to the edges of the band 10**.

On its horizontal path in the upper level the band 10 is driven by a step-by-step drive mechanism 20 diagrammatically represented in FIG. 1 by two pairs of guide wheels 21,22 over which pass endless chains 23 carrying driving grippers (not shown) which grip the edges of the band 10 as long as the latter is at the level of the upper run of the endless chains 23.

For the purpose of transferring the band 10 from the upper level to the lower level downstream of the filling station 3, a guide plate 30, for example a semi-cylindrical guide plate is provided. The guide plate 30 extends between the upper level and lower level and guides the lid band 10 from the downstream end of the upper level to the proximity of the upstream end of the lower level. Subsequently the band 10 is superimposed on the containers 6 starting at point 31 in FIG. 1. In the embodiment illustrated the direction of movement of the band 10 in the upper level is opposite to that of the band 5 and the band 10 in the lower level. It is obvious that the directions of movement of the bands 5, 10 could be the same on the upper and lower levels. In this case the deflection of the band 10 through 180° is not necessary.

Downstream of the point 31 are provided: a covering station 40 containing a storage reel 41 for a guarantee band 42, for example, consisting of an aluminium-thermoplastic film complex, and a deflection and application roller 43 disposed just above the plane of the common path of the band 5 and the band 10, below which roller 43 the guarantee band 42 passes; a welding station 44 for simultaneously sealing the lids 12 on the rim of the containers 6 and the guarantee band 42 on the lids; a cutting station 45 for simultaneously cutting, from the band 5, the band 10, and the guarantee band 42, the individual containers each provided with their lid 12 and a guarantee sheet; and a discharge station 46 for the sealed, individual containers, this station consisting of, for example, an endless conveyor belt.

At the lower level the band 5 is driven by a step-by-step drive mechanism 50 between the guide roller 9 and the cutting station 45. This drive mechanism 50 comprises a step-by-step drive motor (not shown), two pairs of toothed deflection wheels 51, 52, and endless drive chains 53 each of which passes over one of the wheels of each pair of wheels 51, 52 and is provided with driving grippers (not shown), which grip the two edges of the band 5 while the latter is situated adjacent the upper run of the chains 53.

The band 10 and the guarantee band 42 are aligned or centered in relation to the band 5, in such a manner that the longitudinal axes of these bands are all situated in the same vertical plane, which also constitutes the longitudinal vertical median plane of the whole packing installation. The width of the band 10 and that of the guarantee band 42 are preferably equal and slightly smaller than the width of the band 5, so that the driving grippers in contact with the edges of the latter do not hinder the superimposition of the bands 5, 10, 42 downstream of the point 31.

The drive mechanisms 20, 50 for the band 10 at the upper level, on the one hand, and for the band 5, on the other hand, are synchronised by a transmission 60 which comprises for example a transmission chain 61, two toothed wheels 62, 63 which co-operate with the chain 61. The wheel 63 is mounted for rotation with the wheel 52 of the drive mechanism 50. The wheel 63 is mounted for rotation about a fixed shaft and drives a toothed wheel 64 which is in mesh with a toothed wheel 65 mounted for rotation with the guide wheel 22. Between the wheels 63, 64 may be provided a speed variator (not shown), which makes it possible to vary the transmission ratio between the drive mechanism 20, 50 and to ensure that, despite slight longitudinal shrinkage of the band 5 over a free curved path between the upper level and the lower level in the region of the guide plate 30, the advance step of the band 10 is identical to that of the band 5 downstream of the guide plate 30. In other words this speed variator must make it possible to impart to the band 10, while it is held by the driving grippers of the drive mechanism 20, a step slightly greater than that of the band 5, in order to take into account the longitudinal shrinkage of the band 10 while it is free.

Obviously the band 10 loses all ability to shrink as soon as it is welded to the band 5 at the welding station 44. At the lower level the band 10 is fastened to the band 5 and therefore, like the guarantee band 42 welded to the band 10, is driven by the band 5.

One form of construction of the lids 12 is illustrated in FIGS. 2 to 6. After the band 10 has been brought by the station 13 to a temperature suitable for thermoforming, there are formed in the band, at the station 14 and between two advance steps, a plurality of profiled portions 12*a,* which are aligned in a direction perpendicular to the edges of the band 10 (see FIGS. 2 and 3). Each profiled portion 12*a* is in the form of a shallow dish of a section which is, for example, rectangular and which at the centre has a hollow gripping button 12*c* starting at the bottom 12*d* of the dish and not exceeding in height the height of the dish. The side wall 12*e* of the profiled portion 12*a* has in the present embodiment the shape of a pyramid or truncated pyramid and is lightly inclined in relation to the vertical, so that the bottom 12*d* of the dish has a section slightly smaller than that of the dish opening 12*f.*

It will be understood that the inclination of the side wall 12*e* may also be greater and that it is in general shaped to conform to the shape of the side wall of the containers 6.

The profiled portions 12*a* and the length of band 10 in which they are formed are then transported into the partial cutting station 15 where an incision or cut-out 12*g* is made in the flat portion of the band 10, the periphery of the incision or cut-out extending parallel to that of the side wall 12*e* and at a certain distance therefrom so as to form a flat dish rim 12*h.* The incision 12*g* is situated inside the final cutting line intended to coincide with the periphery of the outer rim of the respective container 6. At a predetermined point, for example, on the leading edge, in the direction of movement of the band 10 (See FIG. 4) or at the centre of the lateral sides (see FIG. 8), the dish rim 12*h* is attached to the band 10 by one or more attachment or connection tongues 12*i* corresponding to or coinciding with a straight line situated in the plane of the band 10 and extending perpendicularly to the edges of the band 10.

Figures 2, 3, 4, 5, 6, 7:
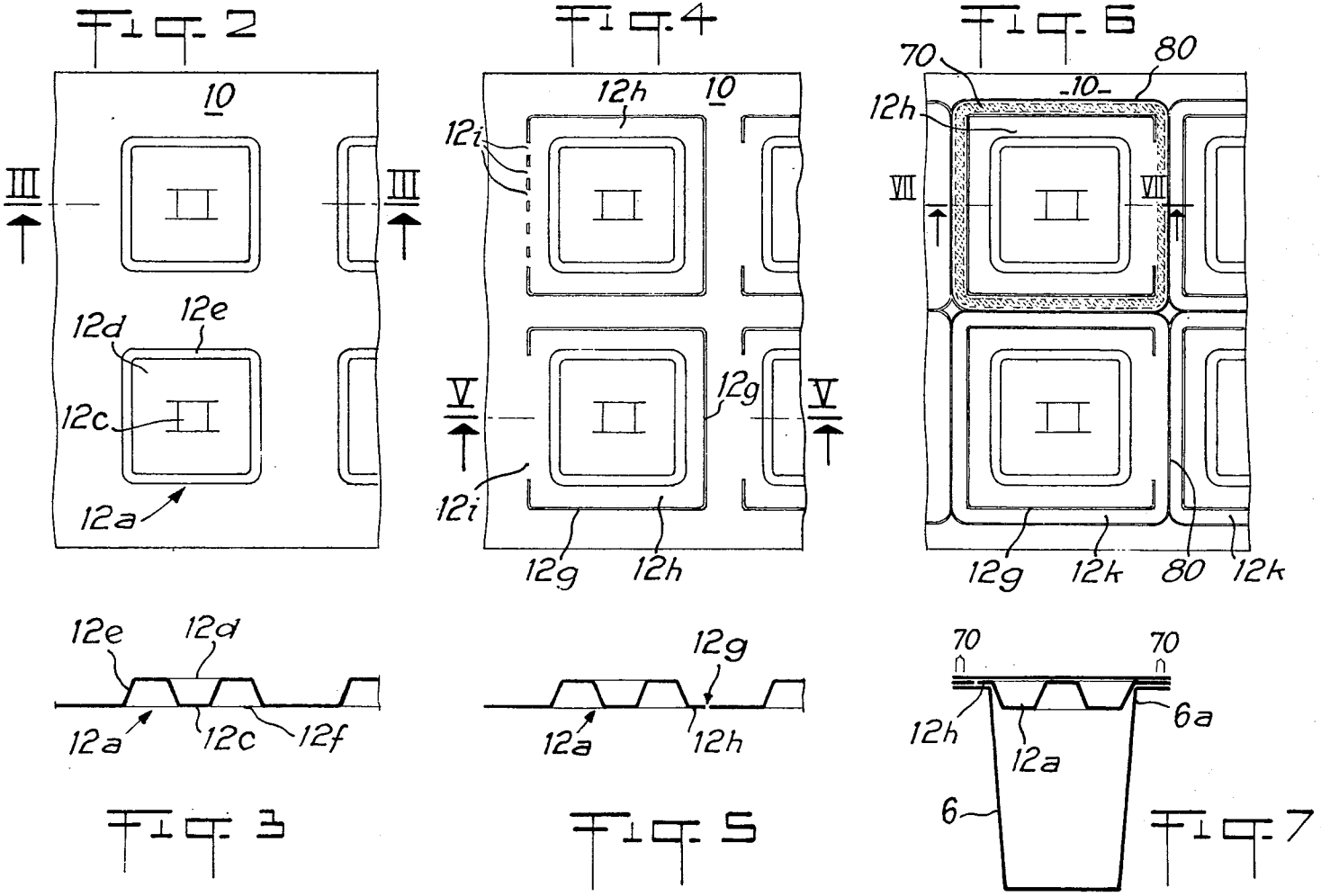
FIG. 2 is a bottom plan view of a portion of a lid band of a container according to the present invention.
FIG. 3 is a view in vertical section on the line III—III in FIG. 2.
FIG. 4 is a bottom plan view of a portion of the lid band showing profiled and partially cut-out portions.
FIG. 5 is a vertical section on the line V—V of FIG. 4.
FIG. 6 is a top plan view of several packing containers according to the present invention.
FIG. 7 is a section taken on the line VII—VII in FIG. 6.

In the upper portion of FIG. 4 are shown a plurality of tongues 12*i* which are aligned in a straight line and situated on the leading edge of the dish rim 12*h,* while in the lower part of this Figure there is shown a tongue 12*i* of great length, its length being substantially equal to the width of the profiled portion 12*a.* This tongue 12*i* is obviously composed of the same material as the lid band 10, which is also the material of which the profiled portions 12*a* and the dish rims 12*h* are made. This attachment tongue 12*i* may have the same thickness as the dish rim 12*h* or be of reduced thickness in relation to the thickness of the dish rim 12*h,* and may thus have a weakened line which facilitates the subsequent detachment of the profiled portion 12*a.*

It will be appreciated that as the result of the aligned arrangement of the tongues 12*i* either along the same transverse edge of the profiled portion 12*a* (FIG. 4) or on each lateral side and, preferably in the centre thereof, of the profiled portion 12*a,* the different profiled portions 12*a* can move without undue stress being applied thereto whilst the band 10 moves over the guide plate 30. Each profiled portion, in fact, remains attached to the band 10 only on a single straight line parallel to the generatrices of the guide plate 30.

The approximate positions of the profiled portions 12*a* as the band 10 moves over the guide plate 30 are shown in FIG. 1 for the case where the tongues 12*i* are situated along a leading edge of the profiled portion and in FIG. 9 for the case where the tongue 12*i* is disposed at the centre of each lateral side of the profiled portion 12*a* (FIG. 8).

After passing over the guide plate 30, the profiled portions 12*a* are introduced into the open ends 6*a* of the containers 6, moving step-by-step along the lower level. The profiled portions 12*a* are placed in position in this way at the point 31, downstream of which, the band 10, whose profiled portions 12*a* are now introduced into open ends of the containers 6, is covered by the guarantee band 42. The assembly comprising the band 5, the band 10, and the guarantee band 42 is introduced, piece by piece and with the stepwise movement of the band 5, into the station 44. In the station 44 the edges of the different bands, surrounding the open ends 6*a* of the containers 6, are heated and sealed together in a manner known per se.

It should be observed that sealing or welding tools are so arranged in the station 44 that a welding zone 70 is produced and is situated outside the dish rim 12*h* and is in the form of a thin bead closed on itself and disposed parallel to the dish rim 12*h*.

For the sake of clarity there is shown, in the top part of FIG. 6, only the welding zone 70 connecting the guarantee band 42 to the band 10, without the guarantee band 42 being shown. On the other side of the welding zone 70 the band 10 is sealed on the flat portion of the band 5 with the aid of another welding zone of identical shape to the welding zone 70 which is situated on the upper face of the band 10; in other words, the two welding zones are situated outside the periphery of the partial incision or cut-out 12*g* made in the band 10, and on each side of the latter.

The bands 5, 10, 42 thus sealed are then transported stepwise by the drive mechanism 50 to the station 45. It is in the station 45 that the individual containers 6 are cut off from the bands 5, 10, 42 by forming around each welding zone 70, parallel to the latter and also to the dish rims 12*h*, a cut 80 which is closed on itself.

Once again for the sake of clarity, only the cut 80 formed in the band 10 has been shown in FIG. 6.

The cuts in the band 5 and in the guarantee band 42 are obviously accurately superimposed in the vertical direction. It can also be seen in FIG. 6 that the cut 80 is situated very close to the welding zone 70.

The portion surrounding each profiled portion 12*a* is therefore composed of the dish rim 12*h* and an outer flat ring 12*k*, the dish rim and the flat ring being separated by the incision or cut-out 12*g* and connected together only by the tongue or tongues 12*i*. Only the flat ring 12*k* is welded to a flat annular rim 6*b* of the container 6, the welding zone 70 extending inside the zone between the incision or cut-out 12*g* and the cut 80.

By making the cut 80 simultaneously in the band 10 and in the band 5, the problem of the exact positioning of the lid on the container is thus avoided, although this problem arises when the lid is previously cut out before being placed in position with a cut line intended to coincide with the periphery of the outer edge of the container. Furthermore, the formation of the profiled portion 12*a* in the form of the dish rim 12*h* and the flat ring 12*k* makes it possible, during the use of the container and after the tongue or tongues 12*i* have been broken, to use the assembly formed by the profiled portion 12*a* and the dish rim 12*h* as a closure lid which can rest on the annular rim 6*b* of the container, with accurate centering by the flat ring 12*k* welded on the annular rim.

Once they have been cut off, the sealed containers are then forwarded to an outer packing station (not shown).

The individual containers thus have a guarantee sheet 42*a* welded on the annular rim 12*k* outside the dish rim 12*h*. The profiled portion 12*a* of the lid 12 is engaged in the open end 6*a* of the container 6 with more or less lateral play. The gripping button 12*c* is situated inside the profiled portion 12*a* and is also covered by the guarantee sheet 42*a*. The open end 6*a* of the container 6 is surrounded by an annular rim 6*b*, on the outer marginal zone of which is permanently welded the flat ring 12*k*, whose outer periphery coincides with that of the annular rim 6*b* of the container and whose inner edges are parallel to the incision or cut-out 12*g*, that is to say to the dish rim 12*h*. The flat ring 12*k* can be seen in FIGS. 6, 10 and 11, and, as noted previously, is formed from the band 10 and consequently is made of the same material as the profiled portion 12*a*, whose dish rim 12*h* is connected by the tongue or tongues 12*i* to the flat ring 12*k*. In other words, the flat ring 12*k* is welded, on the one hand, on the guarantee sheet 42*a* by the welding zone 70, and, on the other hand, permanently on the annular rim 6*b* of the container 6. When the guarantee sheet 42*a* has been torn off, access is gained to the lid 12, which can be gripped by means of the gripping button 12*c*. When the profiled portion 12*a* is fixed to the flat ring 12*k* by the two tongues 12*i*, each of which is disposed on one of the lateral sides of the profiled portion 12*a* so as to form a straight line perpendicular to these two opposite sides (see FIG. 8) and preferably passing through the gripping button 12*c*, these tongues 12*i* have to be broken in order to be able to remove the lid. These attachment tongues are fairly easy to break and their destruction may be facilitated by a weakening incision made in the tongues 12*i*. The profiled portion can be re-used and replaced in position on the container 6, where it rests with its dish rim 12*h* on the inner marginal zone of the annular rim 6*b* of the container; the flat ring 12*k* permanently welded on the outer marginal zone of the container rim 6*b* then serves to centre the profiled portion 12*a* when it is replaced in position on the container 6.

One or more attachment tongues 12*i* may also be provided, which are disposed on a straight line coinciding with one of the edges of the profiled portion 12*a* (see FIGS. 4 and 11).

When these tongues 12*i* are not intended to be broken, they will serve as hinges for the profiled portion 12*a* on the flat ring 12*k* permanently welded to the annular rim 6*b* of the container 6. Consequently, the profiled portion 12*a* cannot be lost.

I claim:

1. A packing container provided with a profiled closure lid and a guarantee sheet, the closure lid being sealed on a flat rim of the container and the guarantee sheet being sealed on the edge of the closure lid, the closure lid comprising a flat ring which is sealed to the flat rim of the container and whose outer periphery coincides with the outer periphery of the flat rim of the container, a flat dish rim being formed inside the flat ring and resting freely on an inner marginal zone of the flat rim of the container, the dish rim having an outer periphery of substantially the same shape as the inner periphery of the said flat ring, and being partially connected to the said flat ring by at least one attachment tongue made of the same material as the flat ring and the dish rim, said at least one attachment tongue being disposed in a straight line coinciding with one of the edges of the dish rim, the guarantee sheet being sealed on said flat ring.

2. A packing container as claimed in claim 1 in which the at least one said attachment tongue is provided with an incision of weakening line.

3. A packing container as claimed in claim 1 wherein the guarantee sheet seals only on the flat ring of said closure lid.

4. A packing container provided with a profiled closure lid and a guarantee sheet, the closure lid being sealed on a flat rim of the container and the guarantee sheet being sealed on the edge of the closure lid, the closure lid comprising a flat ring which is sealed to the flat rim of the container and whose outer periphery coincides with the outer periphery of the flat rim of the container, a flat dish rim being formed inside the flat ring and resting freely on an inner marginal zone of the flat rim of the container, the dish rim having an outer periphery of substantially the same shape as the inner periphery of the said flat ring, the dish rim being connected to the flat ring by two attachment tongues situated along two opposite sides of the said dish rim and in a straight line perpendicular to said two opposite sides, the guarantee sheet being sealed on said flat ring.

5. A packing container as claimed in claim 4 in which the straight line passing through the two attachment tongues also passes through a gripping button provided on the profiled closure lid.

6. A packing container as claimed in claim 4 wherein said attachment tongues are provided with a weakening incision.

7. A packing container according to claim 4 wherein the guarantee sheet seals only on the flat ring of said closure lid.

* * * * *